US007757886B2

(12) United States Patent
Ho

(10) Patent No.: US 7,757,886 B2
(45) Date of Patent: Jul. 20, 2010

(54) LOW COST SPILL-AND-GLUG-RESISTANT CUP AND CONTAINER

(75) Inventor: I-Chung Ho, Rancho Palos Verdes, CA (US)

(73) Assignee: Edison Nation, LLC, Charlotte, NC (US)

( * ) Notice: Subject to any disclaimer, the term of this patent is extended or adjusted under 35 U.S.C. 154(b) by 623 days.

(21) Appl. No.: 11/307,912

(22) Filed: Feb. 28, 2006

(65) Prior Publication Data

US 2007/0199961 A1 Aug. 30, 2007

(51) Int. Cl.
*B65D 5/72* (2006.01)

(52) U.S. Cl. ..... 220/719; 220/717; 222/478; 222/547

(58) Field of Classification Search ..... 222/457, 222/478–479, 547, 564, 566; 220/713, 254.3, 220/711, 716–717, 719; 229/404, 906.1
See application file for complete search history.

(56) References Cited

U.S. PATENT DOCUMENTS

| | | | |
|---|---|---|---|
| 129,451 | A | 7/1872 | Baldwin |
| 236,997 | A | 1/1881 | Dodge |
| 570,759 | A | 11/1896 | Law |

(Continued)

FOREIGN PATENT DOCUMENTS

| | | |
|---|---|---|
| CA | 1156464 | 11/1983 |

(Continued)

OTHER PUBLICATIONS

"International Search Report" and "Written Opinion of the International Search Authority" (Korean Intellectual Property Office) in Edison Nation, LLC, International Patent Application Serial No. PCT/2008/076406, dated Mar. 11, 2009, 7 pages.

(Continued)

*Primary Examiner*—Kevin P Shaver
*Assistant Examiner*—Andrew P Bainbridge
(74) *Attorney, Agent, or Firm*—Chad D. Tillman; James D. Wright; Tillman Wright, PLLC

(57) ABSTRACT

The improved low cost cup and container for storing and dispensing liquids has a scoop-like or glug-reducing separator that separates the volume of the container into two sections, the liquid storage section and the liquid pouring section. It resists spilling and pours more smoothly than prior containers. When the improved cup and container is tilted for pouring, such that the liquid level inside the storage section of container chamber is higher than the liquid level at the mouth opening of the liquid pouring section, no liquid pours out of the container. The liquid starts to flow out of the mouth opening only after the container is tilted beyond a predetermined start-to-pour angle. The start-to-pour angle is reached when the container is tilted permitting the outside air to pass through the pouring section and into the storage section. The improved container can use two covers or a scoop-like-separator-adapter. The scoop-like-separator is attached to the cover or the adapter mounted to the top of the container with no connection to the side-wall and blocks at least a portion of a projection of the opening into the container storage section.

23 Claims, 3 Drawing Sheets

U.S. PATENT DOCUMENTS

| | | | | | |
|---|---|---|---|---|---|
| 836,466 | A | | 11/1906 | Sears | |
| 845,175 | A | | 2/1907 | Hutchins | |
| 1,151,997 | A | | 8/1915 | Beck et al. | |
| 2,249,197 | A | | 7/1941 | Brundin | |
| 2,370,820 | A | | 3/1945 | Stott | |
| 2,387,699 | A | | 10/1945 | Bates | |
| 2,723,341 | A | | 11/1955 | Greenspan | |
| 3,067,543 | A | | 12/1962 | Bracey | |
| 3,090,532 | A | | 5/1963 | Robson | |
| 3,171,580 | A | | 3/1965 | Davis et al. | |
| 3,235,143 | A | * | 2/1966 | Goodrich | 222/454 |
| 3,271,900 | A | | 9/1966 | Mori | |
| 3,410,459 | A | | 11/1968 | Conley | |
| 3,753,315 | A | | 8/1973 | Adam | |
| 3,860,162 | A | | 1/1975 | Schutz | |
| 3,881,506 | A | | 5/1975 | Hazen | |
| 3,902,652 | A | * | 9/1975 | Malcolm | 222/81 |
| 3,927,794 | A | | 12/1975 | Erdman | |
| 4,073,397 | A | | 2/1978 | Snodgrass | |
| 4,148,155 | A | | 4/1979 | Allen | |
| 4,185,414 | A | | 1/1980 | Miller | |
| 4,245,752 | A | | 1/1981 | Prueher | |
| 4,341,040 | A | | 7/1982 | Smith | |
| 4,346,532 | A | | 8/1982 | Peterson | |
| 4,349,864 | A | | 9/1982 | Smith | |
| 4,361,249 | A | * | 11/1982 | Tuneski et al. | 220/254.3 |
| D270,518 | S | | 9/1983 | Duering | |
| 4,412,633 | A | | 11/1983 | Guerrazzi et al. | |
| 4,437,587 | A | | 3/1984 | Duering | |
| 4,441,623 | A | | 4/1984 | Antoniak | |
| 4,491,245 | A | | 1/1985 | Jamison | |
| D288,334 | S | | 2/1987 | Simons | |
| D288,889 | S | | 3/1987 | Mantani | |
| 4,805,342 | A | | 2/1989 | Jenkins et al. | |
| 4,829,708 | A | | 5/1989 | Gonzalez | |
| 4,829,709 | A | | 5/1989 | Centafanti | |
| 4,856,685 | A | * | 8/1989 | Gaffney | 222/454 |
| 4,864,771 | A | | 9/1989 | Fah | |
| 4,896,457 | A | | 1/1990 | Pitcher | |
| 4,925,051 | A | | 5/1990 | Herbst | |
| 4,935,283 | A | | 6/1990 | Jamison | |
| 4,999,947 | A | | 3/1991 | Whitaker | |
| 5,044,120 | A | | 9/1991 | Couch | |
| 5,067,501 | A | | 11/1991 | Auger | |
| 5,085,355 | A | | 2/1992 | Yoshimura et al. | |
| 5,123,575 | A | * | 6/1992 | Li | 222/564 |
| 5,180,552 | A | | 1/1993 | Saceman | |
| 5,201,860 | A | | 4/1993 | Richardson | |
| 5,217,696 | A | | 6/1993 | Wolverton et al. | |
| 5,241,784 | A | | 9/1993 | Henry | |
| 5,269,094 | A | | 12/1993 | Wolverton et al. | |
| 5,277,877 | A | | 1/1994 | Jeffery et al. | |
| D348,802 | S | | 7/1994 | Miller | |
| 5,329,729 | A | | 7/1994 | Liang | |
| 5,340,000 | A | * | 8/1994 | Ring | 222/468 |
| 5,351,438 | A | | 10/1994 | Wolverton et al. | |
| 5,356,053 | A | | 10/1994 | DiFatta | |
| 5,430,972 | A | | 7/1995 | Wianecki | |
| 5,433,923 | A | | 7/1995 | Wolverton et al. | |
| 5,454,187 | A | | 10/1995 | Wasserman | |
| 5,467,903 | A | | 11/1995 | Sorensen et al. | |
| 5,509,568 | A | | 4/1996 | Warden et al. | |
| 5,509,579 | A | | 4/1996 | Robbins | |
| 5,547,109 | A | | 8/1996 | Robbins | |
| 5,579,962 | A | | 12/1996 | Chen | |
| 5,638,638 | A | | 6/1997 | Moskowitz | |
| 5,669,329 | A | | 9/1997 | Krause | |
| 5,682,932 | A | | 11/1997 | Ediger | |
| 5,749,170 | A | | 5/1998 | Furuta | |
| 5,819,994 | A | | 10/1998 | Leipold | |
| 5,897,035 | A | | 4/1999 | Schlomer | |
| 5,979,689 | A | * | 11/1999 | Lansky | 220/255 |
| 6,098,850 | A | | 8/2000 | Ho | 222/185 |
| 6,220,476 | B1 | * | 4/2001 | Waller | 220/719 |
| 6,305,571 | B1 | * | 10/2001 | Chu | 220/719 |
| 6,374,541 | B1 | | 4/2002 | Ho | 47/79 |
| 6,412,664 | B1 | * | 7/2002 | Wolff et al. | 222/211 |
| 6,419,105 | B1 | | 7/2002 | Bruce et al. | |
| 6,431,390 | B1 | | 8/2002 | Waller | |
| 6,460,741 | B1 | * | 10/2002 | Ho | 222/482 |
| 6,533,139 | B2 | * | 3/2003 | Lukacevic | 220/719 |
| 6,612,456 | B1 | | 9/2003 | Hundley et al. | |
| 6,702,145 | B2 | * | 3/2004 | Malcolm | 220/713 |
| 6,758,375 | B2 | * | 7/2004 | Ho | 222/454 |
| 7,063,224 | B2 | | 6/2006 | Clarke et al. | |
| 7,641,070 | B2 | | 1/2010 | Ho | |
| 2007/0199945 | A1 | | 8/2007 | Ho | |
| 2008/0000920 | A1 | | 1/2008 | Ho | |

FOREIGN PATENT DOCUMENTS

| | | |
|---|---|---|
| CA | 2411289 | 7/2003 |
| CA | 2315028 | 10/2007 |
| CA | 2635219 | 7/2008 |
| DE | 864469 | 1/1953 |
| DE | 3418266 | 12/1985 |
| EP | 195542 | 9/1986 |
| FR | 661013 | 7/1929 |
| FR | 1473290 | 3/1967 |
| FR | 2305123 | 10/1976 |
| GB | 2218609 | 11/1989 |
| GB | 2250171 | 6/1992 |
| JP | 2-092318 | 3/1990 |
| WO | 9424011 | 10/1994 |
| WO | 2009/036426 A2 | 3/2009 |

OTHER PUBLICATIONS

Information Disclosure Statement (IDS) Letter Regarding Common Patent Application(s), submitted by Applicant on Mar. 3, 2009.
Nformation Disclosure Statement Letter Regarding Common Patent Applications dated Oct. 13, 2009.
Information Disclosure Statement (IDS) Letter Regarding Common Patent Applciation(s), dated Feb. 16, 2010.

* cited by examiner

LOW COST SPILL-AND-GLUG-RESISTANT CUP AND CONTAINER

FIELD OF THE INVENTION

The field of the invention is cups and other containers for dispensing a liquid and more particularly, is containers for dispensing a liquid with a smoother pour and/or with reduced spilling.

BACKGROUND OF THE INVENTION

Man has used containers for storing and dispensing liquids for millennia. However, containers still have their problems. For example, full cups of soda and hot coffee sold in fast food restaurants being consumed in moving cars have caused many spilling accidents. Although these cups may be equipped with sealing lids with small mouth openings, spilling mishaps are still very common. Serious burns or a moving car accident may result from a very hot coffee spill. Therefore, there is a need for an improved low cost disposable cup and container, which ideally does not spill while drinking and, realistically is spill-resistant.

When pouring liquid from a container, the same volume of air should enter the container to replace the liquid being poured out. A phenomenon referred to as "glugging" occurs when the liquid is poured more quickly from the container than air can enter the container. Glugging occurs when too much liquid tries to flow out of the container and there is not enough room available in the outflow passageway for air to enter into the container to replace the volume of the outflowing liquid. When this happens, a partial vacuum is created inside the container that momentarily stops liquid from flowing out. Once the liquid flow stops, air starts to enter the container and when the incoming air has eliminated the partial vacuum, the liquid can resume its out flow. This intermittent and repeated liquid flowing and stopping is referred to as "glugging" and makes the pouring unstable, undesirable and less smooth. Glugging is also a major cause of spills. Therefore, there is also a need for a container, which reduces the glugging effect.

On the market, some container designs have a hollow handle molded near the mouth opening of the container. An air vent passageway is provided between the mouth opening and the hollow handle so that a separate air vent is provided. The air from the mouth opening travels down the vent passageway, through the hollow handle, and into the container to help reduce glugging. However, a full container may spill easily when tilted slightly, a further improved container, which better eliminates spilling and glugging and improves the smoothness of the liquid flow is needed.

This inventor has developed a number of spill-resistant containers; U.S. Pat. Nos. 6,098,850; 6,374,541; 6,460,741; and 6,758,375; using a hydrostatic principle in achieving the spill-resistant feature. The present invention simplifies the design and allows a scoop-like-separator to be made as either an integral part of the container or as separate parts of the container easily assembled such as container covers.

SUMMARY OF THE INVENTION

The improved cup and container for storing and dispensing liquids has an internal separator, that in a preferred embodiment, is a scoop-like separator. The improved container resists spilling and pours the liquid more smoothly. The scoop-like-separator may include an optional vent hole or a number of small holes for reducing "glugging" further. When the cap of the cup is equipped with a mouth piece, this vent hole will allow for air to enter the cup while the mouth opening is covered by the mouth and allowing the liquid to be sucked out more smoothly.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. Moreover, in the figures, like reference numerals designate corresponding parts throughout the different views. However, like parts do not always have like reference numerals. Moreover, all illustrations are intended to convey concepts, where relative sizes, shapes and other detailed attributes may be illustrated schematically rather than literally or precisely.

DETAILED DESCRIPTION OF THE INVENTION

Figure 1:
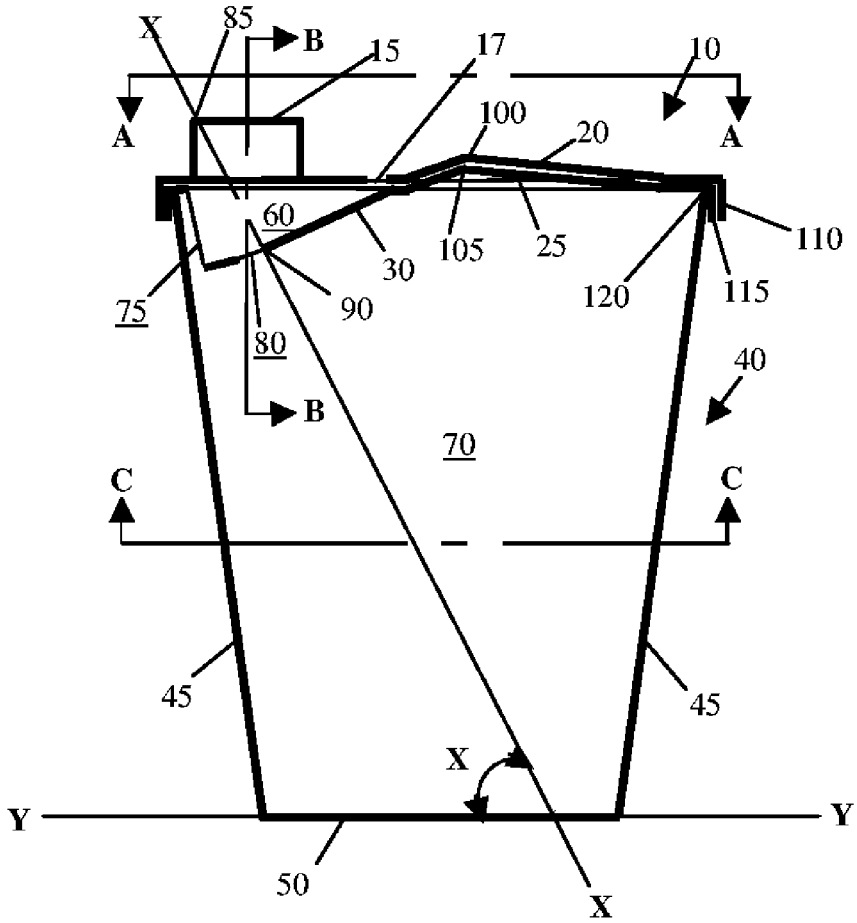
FIG. 1 is a schematic representation of a cross-sectional side view of an example embodiment of the spill-and-glug-resistant cup including an ordinary body of the cup, an upper cover, and a lower cover having a scoop-like-separator.

FIG. 1 is a schematic representation of the cross-sectional side view of a preferred example embodiment of a spill-and-glug-resistant cup 10, which is referred to as a scoop-separated container. The heavy dark line shown in this drawing and all following drawings represent the cut walls of the container. FIGS. 1-5 illustrate various views of a substantially circular container 10 (the circular shape of the body of the container as illustrated here serves only as an example because it can be in many other shapes and forms). A removable upper cover 20 has a pouring mouth opening 15 and an optional vent hole 17. A removable lower cover 25 contains a scoop-like or glug-reducing separator 30. In each of the embodiments, the scoop-like separator can be made flat, curved, concave, or convex, for example. The body of the circular cup 40 has the side-wall 45 and the bottom 50. The scoop-separated container 10 is assembled by covering the body of the circular cup 40 with the lower cover 25 and then the upper cover 20. The scoop-like-separator 30 in the lower cover 25 acts as a partition dividing the scoop-separated container 10 into a pouring section 60 and a storage section 70 communicating through the opening of the scoop-like-separator 30 at the interface opening area 75 and a vent opening area 80. The storage section 70 of the scoop-separated container 10 has no opening to the outside ambient air except through the interface opening area 75 and the vent opening area 80. The vent opening area 80 can be as small as a pinhole, a number of small holes or as large as being connected to the interface opening area 75 and formed as a one large opening area (as shown in this example). When pouring liquid out from the scoop-separated container 10, liquid in the storage section 70 flows through interface opening area 75 into pouring section 60 and then out of mouth opening 15. At the same time, outside air enters the scoop-separated container 10 through the mouth opening 15, or through the optional extra vent hole 17, into the pouring section 60 and then through the vent opening area 80 into the storage area 70 to replace the volume of liquid being flown out. When the scoop-separated container 10 is tilted in the counter-clockwise direction (as illustrated in this figure and better shown in FIG. 6), the mouth opening 15 has a lowest point 85 and the vent opening area 80 on the scoop-like separator 30 has an apex 90. Connecting the lowest point 85 and the apex 90 with a straight line forms a start-to-pour line X-X. The angle between the start-to-pour line X-X and the horizontal line Y-Y is the start-to-pour angle X. For example, the start-to-pour angle can be designed to be greater than 45 or 60 degrees or any other angles based on user's preference. The usage of this start-to-pour line X-X will be described later.

The addition of the vent hole 17 in the upper cover 20 will enable the pouring of liquid further smoother especially when the mouth opening 15 is made in the form of a mouth piece such that a drinker's mouth may cover the entire mouth opening 15 while sucking liquid out from the scoop-separated container 10. Preferably, the location of this optional vent hole 17 should be located within the enclosure of the scoop-like-separator 30 (more clearly shown in FIG. 2) and far away from the lowest point 85.

There is an optionally raised or lowered portion 100 of any suitable shape and size in the upper cover 20 that acts as a register key with a mating raised or lowered portion 105 in the lower cover 25. This allows the placing of both covers onto the body of the cup 40 to always have the same matched relative location and form the same predetermined start-to-pour line X-X and therefore a predetermined start-to-pour angle X. The top cover 20 has a circular lip 110 which can be sealingly snap onto a mating circular lip 115 of the lower cover 25 after the lower cover 25 is sealingly snap onto the lip 120 of the body of the cup 40.

Figure 2:
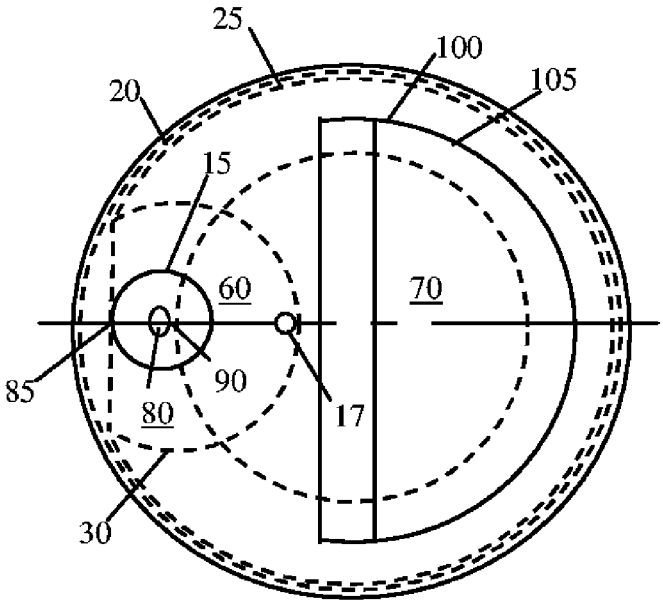
FIG. 2 is a schematic representation of the top view of the spill-and-glug-resistant cup taken along line A-A of FIG. 1.

FIG. 2 is a schematic representation of the top view of the scoop-separated container 10 of FIG. 1 taken along line A-A. Viewing from the top of the scoop-separated container 10, it is clearly shown that the scoop-like-separator 30 surrounds the mouth opening 15 and separates the pouring section 60 from the storage section 70 communicated only by the interface opening area 75 and the vent opening area 80. In this view, the scoop-like-separator 30 surrounding and blocking at least a portion of a projection of the mouth opening 15 into the container storage section 70.

Figure 3:
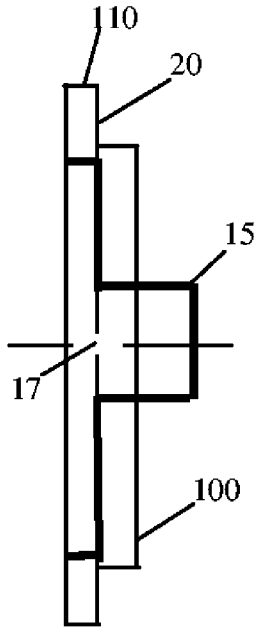
FIG. 3 is a schematic representation of a cross-sectional side view of the upper cover (without the lower cover and the body) of the spill-and-glug-resistant cup taken along line B-B of FIG. 1.

FIG. 3 is a schematic representation of a cross-sectional view of the upper cover 20 without the lower cover 25 and the body of the scoop-separated container 10 along line B-B in FIG. 1. Ignoring any special features, the rest of this upper cover 20 is similar to most low cost disposable cup covers currently used by the public. The optional vent hole 95, however, is better located within the projected enclosure of scoop-like-separator 30 and far away from the lowest point 85 (as shown in FIGS. 1 and 2). In the preferred embodiment, the circular lip 110 around the edge of the upper cover 20 snaps sealingly onto the circular lip 115 of the lower cover 25 instead of the lip of the cup 120.

Figure 4:
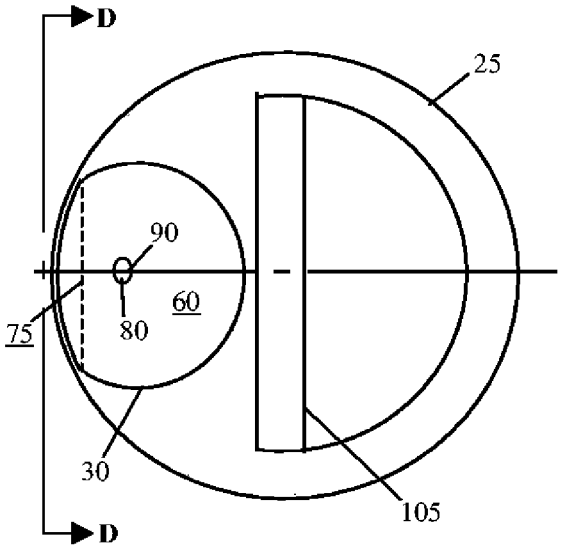
FIG. 4 is a schematic representation of the bottom view of the lower cover (without the upper cover and the body) of the spill-and-glug-resistant cup taken along line C-C of FIG. 1.
Figure 5:
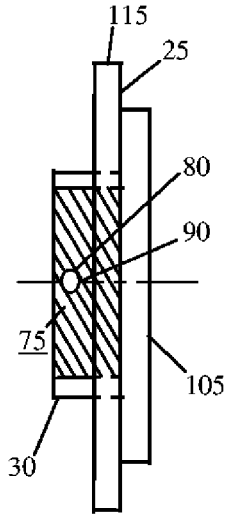
FIG. 5 is a schematic representation of the side view of the lower cover of the spill-and-glug-resistant cup taken along line D-D of FIG. 4.

FIG. 4 is a schematic representation of the bottom view of the lower cover 25 without the upper cover 20 and the body of the scoop-separated container 10 along line C-C in FIG. 1. FIG. 5 is a schematic representation of the side view taken along line D-D of FIG. 4. This lower cover 25 contains the separator 30 which is a critical component that makes the improved scoop-separated container 10 achieve its intended spill-and-glug-resistant function. This lower cover 25 has a full circular sealing lip 115 like the upper cover 20. In this embodiment, the scoop-like-separator 30 has a concave scoop-like surface formed in the direction away from the upper cover 20. This concave scoop-like-separator combined with the assembled upper cover forms the volume of the pouring section 60. This lower cover 25 can be easily and very inexpensively manufactured like the upper cover 20 by thermal vacuum forming from a thin plastic sheet or other very low cost methods. The use of two covers instead of one combined cover makes it possible to manufacture the covers with very low cost methods such as the thermal vacuum forming. This scoop-like-separator 30 does not connect to any part of the side-wall of the scoop-separated container 10.

An alternate single cover that combines the essential components of both upper and lower covers 20 and 25 will also make the container work. However, the process of making this combined cover cannot be made by thermal vacuum forming and is more difficult and may require higher costs. Another method of making this combined cover is to sealingly assemble the scoop-like-separator 30 to the combined cover. The scoop-like-separator 30 provides a small volume of pouring section 60. This pouring section 60 is sealingly isolated to the storage section 70 of the scoop-separated container 10 by the wall of the scoop-like-separator 30 with the only interface opening area 75 and the vent opening area 80 as the communicating area.

Figure 6:
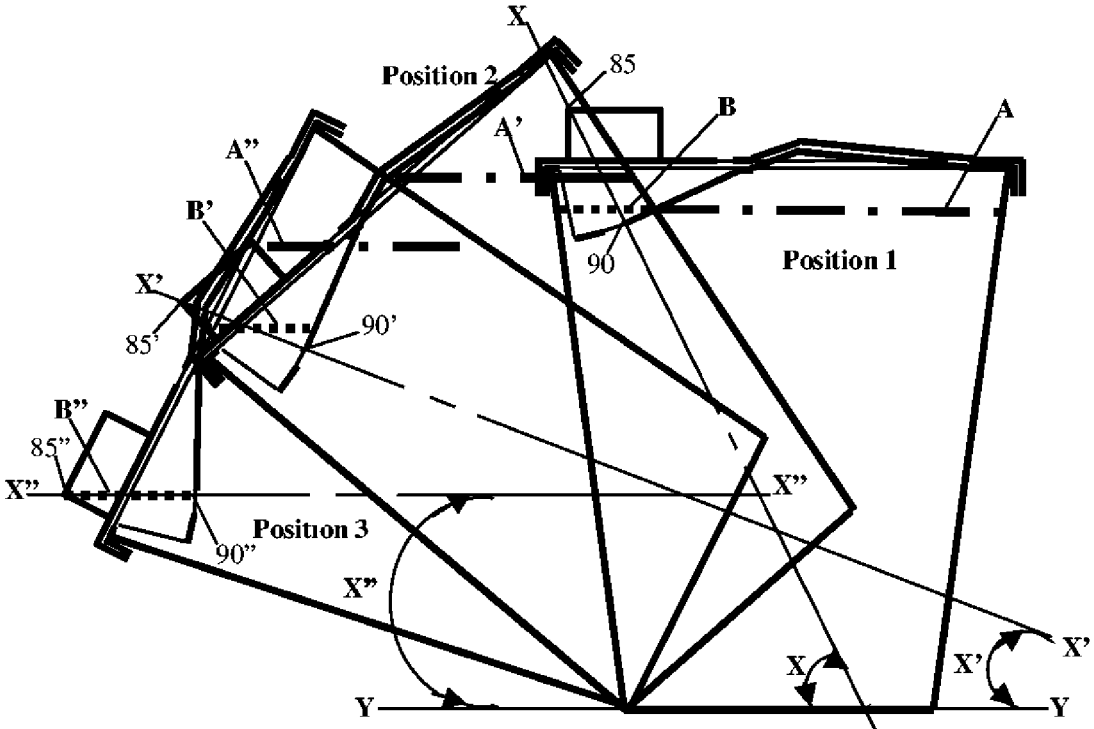
FIG. 6 is a schematic representation of the spill-and-glug-resistant cup of FIG. 1 rotating in counter-clockwise direction in three different angles from the vertical position 1 to the start to pour position 3 through intermediate position 2.

FIG. 6 is a schematic representation of the scoop-separated container 10 of FIG. 1 rotating in counter-clockwise direction in three different angles from the vertical position 1 to the start to pour position 3 through intermediate position 2. At position 1 the full scoop-separated container 10 has a liquid level line A in the liquid storage section 70 and a liquid level line B in the liquid pouring section 60. When the scoop-separated container 10 is tilted from position 1 to position 2, the liquid level line A in the liquid storage section 70 is moved to liquid level line A' and the liquid level line B in the liquid pouring section 60 is moved to liquid level line B'. At this position the start-to-pour line X-X changed to line X'-X' and the angle X reduced to X'. The liquid level line B' in the pouring section 60 is lower than the lowest point 85 in the mouth opening 15 and higher than the apex 90 at the scoop-like-separator 30. Because at this tilting angle, the liquid level line B' stops outside air from entering the vent opening area 80 into the liquid storage section 70. Due to partial vacuum created inside the storage section 70 liquid inside the storage section 70 cannot flow out of the mouth opening 15. This allows the liquid level A' in the storage section 70 to be higher than the mouth opening 15 without allowing the out flow of liquids and thus preventing the spilling of liquid. When the scoop-separated container 10 is tilted further from position 2 to position 3, the liquid level line A in the liquid storage section 70 tilted to liquid level line A" and the liquid level line B in the liquid pouring section 60 tilted to liquid level line B". The start-to-pour angle X is reduced from X to X" or zero degrees. The start-to-pour line X"-X" is now parallel to the horizontal line Y-Y and is in line with the liquid level line B" in the pouring section 60. At this tilting angle, the liquid level line B" is in line with the lowest point 85 in the mouth opening 15 and the apex 90 at the scoop-like-separator 30. At any slight increase in tilting angle, outside air will start to enter from the mouth opening 15 into the pouring section 60 and through the vent opening area 80 at the apex point 90 into the storage section 70. Once air starts to enter the storage section 70, the partial vacuum inside the storage section 70 is lost and the liquid inside the storage section 70 will start to pass through the interface opening area 75 into pouring section 60 and pour out of the mouth opening 15. When the vent opening area 80 is large and connected with the interface opening area 75, there is no distinct separation of the liquid flow area and the vent area, the proportion sizes of these two areas may change depending on the tilting angle or the rate of pouring of the liquid from the container. When pouring a liquid from a container, the same volume of air must enter the container to replace the volume of liquid being poured out. A phenomenon referred to as "glugging" occurs when the liquid is poured more quickly from the container than air can enter into the container. Glugging occurs when too much liquid tries to flow out of the container and there is not enough room available in the outflow passageway for air to enter into the container to replace the volume of the out-flowing liquid. When this happens, a partial vacuum is created inside the container that momentarily stops liquid from flowing out. Once the liquid flow stops, air starts to enter the container and when the incoming air has eliminated the partial vacuum, the liquid can resume its out flow. This intermittent and repeated liquid flowing and stopping is referred to as "glugging" and makes the pouring unstable, undesirable, less smooth and easy to spill. The separate vent opening 80 with a pointed notch at the apex location helps to guide a steady small amount of incoming air in a more smooth and less-interrupted manner through the vent opening area 80 at the apex point 90 to further reducing the glugging. The use of an extra vent hole 17 in the upper cover 20 allows air to enter the pouring section 60 from other than the mouth opening 15 which may be covered by the mouth of a drinker will improve the glugging further.

Figure 7:
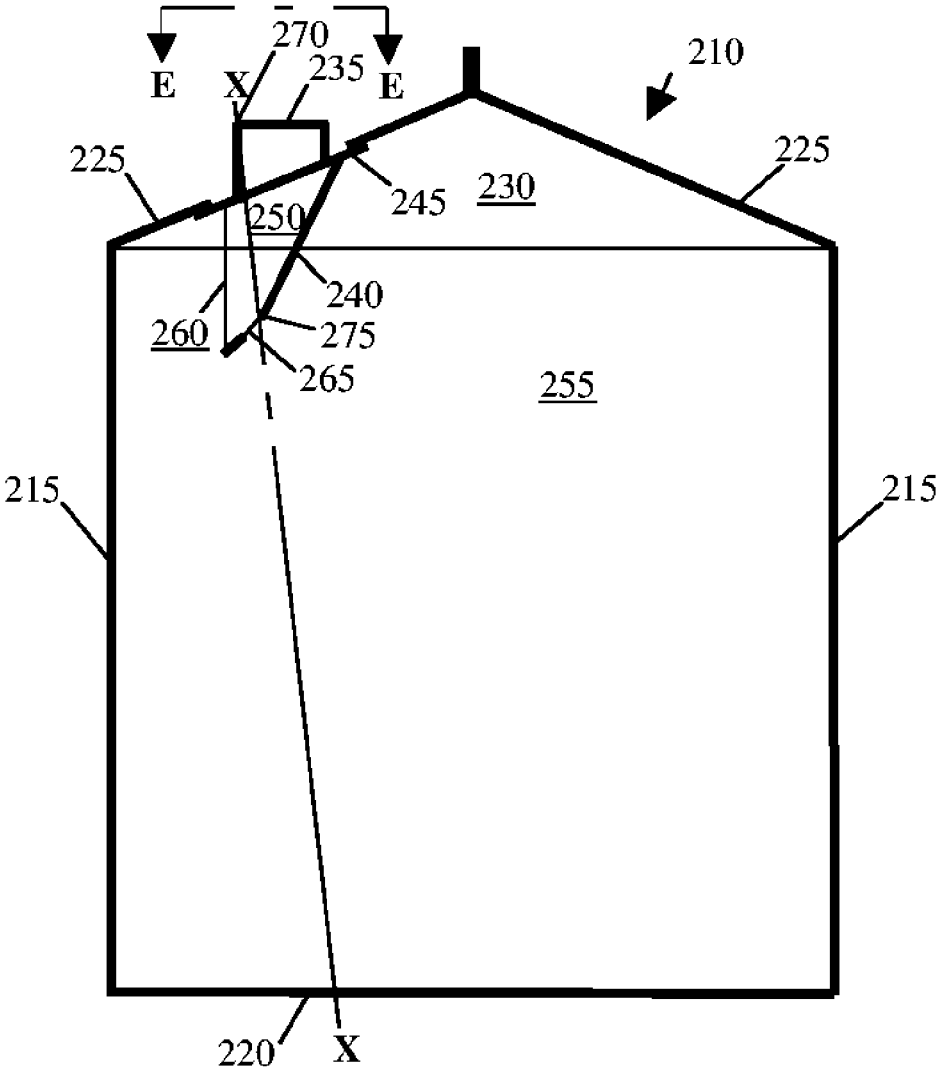
FIG. 7 is a schematic representation of a cross-sectional side view of another example embodiment of a spill-and-glug-resistant container. The body of this example is a container formed by a folded carton box similar to those being sold in the market. An adapter with a mouth opening with built-in scoop-like-separator is sealingly attached to the carton box by a flange.

FIG. 7 is a schematic representation of a cross-sectional side view of another example embodiment of a preferred spill-and-glug-resistant container. The body of this example embodiment is a container formed by folding a single sheet of carton paper into a carton box 210 which is the same as the carton box containers being sold in the market. This rectangular carton box has four side-walls 215, a bottom 220, two slopped top panels 225 and two slanted connecting panels 230. To improve the pouring of this standard carton box container, an adapter with a mouth opening 235, a built-in scoop-like-separator 240 and a mounting flange 245 are sealingly attached to a cutout hole in one of the top panel 225 of the carton box 210. Like the example container depicted in FIGS. 1-6, the built-in scoop-like-separator 240 separates the volume of the carton box 210 into a pouring section 250 and a storage section 255 communicating with each other by an interface flow area 260 and a vent opening area 265. The vent opening area 265 can be as small as a pinhole, a number of small holes or as large as being connected with the interface flow area 260. The mouth opening 235 has a lowest point 270 when it is tilted for pouring the liquid. The opening(s) in the built-in scoop-like-separator 240 has an apex 275 in the vent opening area 265. The straight line connecting the lowest point 270 and the apex 275 forms the start-to-pour line X-X. The angle between the start-to-pour line X-X and the horizontal line Y-Y is the start-to-pour angle X.

Figure 8:
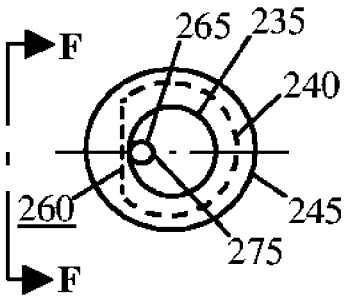
FIG. 8 is a schematic representation of the top view of the adapter with the mouth opening and the scoop-like-separator without the carton box body of the spill-and-glug-resistant container taken along line E-E of FIG. 7.
Figure 9:
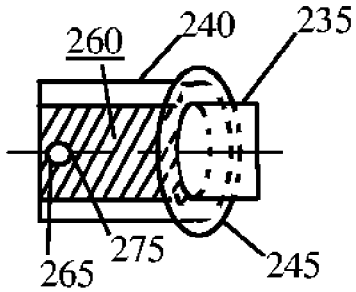
FIG. 9 is a schematic representation of the side view of the adapter with the mouth opening and scoop-like-separator of the spill-and-glug-resistant container taken along line F-F of FIG. 8.

FIG. 8 is a schematic representation of the top view of the mouth opening 235 with a built-in scoop-like-separator 240 and the mounting flange 245 without the body of the spill-and-glug-resistant container, the carton box 210 of FIG. 7 taken along line E-E. FIG. 9 is a schematic representation of the side view of the mouth opening with the built-in scoop-like-separator 240 of FIG. 8 taken along line F-F. The interface area 260 is represented by the shaded areas shown in FIGS. 8 and 9.

What is claimed is:

1. A container for dispensing a liquid with less spilling, the container comprising: an upper cover; a lower cover made of a non-permeable, non-porous material; a bottom opposite the upper and lower covers; a container body disposed between the upper cover and the bottom; the container body including a liquid storage section and a liquid pouring section; and a mouth opening disposed in the upper cover and adapted to allow a liquid in the container to flow out of the container when the container is tilted beyond a start-to-pour angle, wherein each of the upper and lower covers extends fully across the container body.

2. The container of claim 1 wherein the lower cover includes a separator with an opening that connects the liquid pouring section to the liquid storage section, and wherein the separator blocks at least a portion of a projection of the mouth opening into the liquid storage section so that when the container is tilted less than the start-to-pour angle, the liquid does not flow out of the mouth opening and when the container is tilted beyond the start-to-pour angle, the liquid flows out from the storage section to the pouring section and then out of the mouth opening.

3. The container of claim 2 wherein the separator is a scoop-like separator.

4. The container of claim 3 wherein the scoop-like-separator includes an air vent.

5. The container of claim 1 wherein the start-to-pour angle is greater than 45 degrees.

6. The container of claim 1 wherein the start-to-pour angle is greater than 60 degrees.

7. The container of claim 1 wherein the separator has a curved surface.

8. The container of claim 1 wherein the upper cover has a vent hole.

9. A container for dispensing a liquid with reduced glugging, the container comprising: a cover; a scoop-like-separator attached to the cover and adapted to remain in a stationary position relative to the cover; a bottom opposite the cover; a container body disposed between the cover and the bottom and divided by the scoop-like-separator into a liquid pouring section and a liquid storage section each being separately substantially enclosed, wherein each of the liquid pouring section and the liquid storage section provides a generally unobstructed flow path to liquid situated therein; and a mouth opening disposed on the cover and adapted for the liquid in the container to flow out of the container when the container is tilted beyond a start-to-pour angle.

10. The container of claim 9 wherein the scoop-like separator includes a liquid flow opening and a vent flow opening, connecting the liquid pouring section to the liquid storage section, and wherein the scoop-like separator blocks at least a portion of a projection of the mouth opening into the liquid storage section so that when the container is tilted less than the start-to-pour angle, the liquid does not flow out of the mouth opening and when the container is tilted beyond the start-to-pour angle, the liquid flows out from the storage section to the pouring section and then out of the mouth opening.

11. The container of claim 9 wherein the scoop-like separator includes an air vent.

12. The container of claim 9 wherein the start-to-pour angle is greater than 45 degrees.

13. The container of claim 9 wherein the start-to-pour angle is greater than 60 degrees.

14. The container of claim 9 wherein the scoop-like-separator has a curved surface.

15. The container of claim 9 wherein the cover has a vent hole.

16. A container for dispensing a liquid with reduced glugging, the container comprising: a top; a bottom opposite the top; a container body disposed between and integral with the top and the bottom, the container body being adapted for the storage of liquid; and an adapter extending through the top, the adapter having a separator adapted to divide the container body into a liquid pouring section and a liquid storage section, a mouth opening, and a mounting flange sealingly attached to a container opening in the top; wherein the adapter is adapted for the liquid in the container to flow out of the container when the container is tilted beyond a start-to-pour angle.

17. The container of claim 16 wherein the separator is a scoop-like separator.

18. The container of claim 17 wherein the scoop-like-separator has at least one opening that permits liquid flow and air flow, connecting the liquid pouring section to the liquid storage section, and wherein the scoop-like-separator surrounds and blocks at least a portion of a projection of the mouth opening into the liquid storage section so that when the container is tilted less than the start-to-pour angle, the liquid does not flow out of the mouth opening and when the container is tilted beyond the start-to-pour angle, the liquid flows out from the storage section to the pouring section and then out of the mouth opening.

19. The container of claim 17 wherein the scoop-like-separator includes an air vent.

20. The container of claim 16 wherein the start-to-pour angle is greater than 45 degrees.

21. The container of claim 16 wherein the start-to-pour angle is greater than 60 degrees.

22. The container of claim 17 wherein the scoop-like-separator has a curved surface.

23. The container of claim 16 wherein the separator has at least one opening that permits liquid flow and air flow, connecting the liquid pouring section to the liquid storage section, and wherein the separator blocks at least a portion of a projection of the mouth opening into the liquid storage section so that when the container is tilted less than the start-to-pour angle, the liquid does not flow out of the mouth opening and when the container is tilted beyond the start-to-pour angle, the liquid flows out from the storage section to the pouring section and then out of the mouth opening.

* * * * *